US009149704B1

(12) United States Patent
Picotte

(10) Patent No.: US 9,149,704 B1
(45) Date of Patent: Oct. 6, 2015

(54) GOLF TRAINING BALL

(76) Inventor: Brett H. Picotte, Willard, MO (US)

( * ) Notice: Subject to any disclaimer, the term of this patent is extended or adjusted under 35 U.S.C. 154(b) by 903 days.

(21) Appl. No.: 13/385,418

(22) Filed: Feb. 17, 2012

Related U.S. Application Data

(60) Provisional application No. 61/463,485, filed on Feb. 17, 2011.

(51) Int. Cl.

| | |
|---|---|
| ***A63B 69/36*** | (2006.01) |
| ***A63B 37/12*** | (2006.01) |
| ***A63B 37/00*** | (2006.01) |
| ***A63B 39/00*** | (2006.01) |
| ***A63B 43/04*** | (2006.01) |

(52) U.S. Cl.
CPC ..... *A63B 69/36* (2013.01); *A63B 37/004* (2013.01); *A63B 37/005* (2013.01); *A63B 37/0038* (2013.01); *A63B 37/0072* (2013.01); *A63B 37/0075* (2013.01); *A63B 37/12* (2013.01); *A63B 39/00* (2013.01); *A63B 43/04* (2013.01)

(58) Field of Classification Search
CPC .... A63B 69/36; A63B 69/3688; A63B 37/00; A63B 37/0038; A63B 37/0039; A63B 37/004; A63B 37/005; A63B 37/007; A63B 37/0072; A63B 37/0075; A63B 37/0076; A63B 37/0077; A63B 37/02; A63B 37/04; A63B 37/12; A63B 39/00; A63B 43/00; A63B 43/04; A63B 37/0003; A63B 69/3655
USPC ..... 473/280, 569, 594, 604
See application file for complete search history.

(56) References Cited

U.S. PATENT DOCUMENTS

| | | | | | |
|---|---|---|---|---|---|
| 1,573,093 | A | | 2/1926 | Russel et al. | 473/606 |
| 1,575,281 | A | | 3/1926 | Rosenberg | 66/170 |
| 1,580,230 | A | | 4/1926 | Brereton | 473/280 |
| 1,602,725 | A | | 10/1926 | Travers | 473/219 |
| 1,653,893 | A | | 12/1927 | Eden | 473/280 |
| 2,210,954 | A | | 8/1940 | Roberts | 156/161 |
| 2,264,802 | A | | 12/1941 | Kohl | 473/280 |
| 2,364,955 | A | | 12/1944 | Diddel | 473/372 |
| 2,450,474 | A | | 10/1948 | Grobner | 28/117 |
| 3,039,773 | A | | 6/1962 | Teegaurden et al. | 473/606 |
| 3,069,170 | A | | 12/1962 | Dillon, Jr. | 473/280 |
| 3,081,091 | A | | 3/1963 | Grow | 473/280 |
| 3,288,469 | A | | 11/1966 | Shaw | 473/280 |
| 3,325,168 | A | | 6/1967 | Fyanes | 473/235 |
| 3,357,705 | A | | 12/1967 | Blanchard | 473/280 |
| 3,410,562 | A | | 11/1968 | Lefleur | 473/231 |
| 3,498,613 | A | * | 3/1970 | Dreyer | 473/575 |
| 3,572,696 | A | | 3/1971 | Poynter | 272/27 |
| 3,679,206 | A | | 7/1972 | Shambaugh | 273/32 R |
| 3,721,447 | A | | 3/1973 | Louderback | 273/186 E |
| 3,754,761 | A | | 8/1973 | Pruss | 273/200 A |
| 3,995,855 | A | * | 12/1976 | Schultz | 473/594 |

(Continued)

FOREIGN PATENT DOCUMENTS

FR 2440207 10/1979

*Primary Examiner* — Raleigh W Chiu
(74) *Attorney, Agent, or Firm* — Jonathan A. Bay

(57) ABSTRACT

A short-flight golf training ball has a spherical hollow rubber carcass, a felt cover, and a hard spherical inner core. The spherical hollow rubber carcass has a spherical outer wall and a spherical interior wall defining a hollow spherical interior that has an interior diameter. The felt cover affixed to the outer wall. The hard spherical inner core has an outer diameter that is less than interior diameter of the carcass and is free or substantially free to move around at will in the hollow spherical interior.

19 Claims, 5 Drawing Sheets

(56) References Cited

U.S. PATENT DOCUMENTS

| | | | | | |
|---|---|---|---|---|---|
| 4,026,561 | A | | 5/1977 | Baldorossi et al. | 273/193 R |
| 4,065,126 | A | | 12/1977 | Mantz | 273/58 A |
| 4,151,029 | A | | 4/1979 | Jones-Hinton | 156/145 |
| 4,194,737 | A | * | 3/1980 | Farmer | 473/570 |
| 4,201,384 | A | | 5/1980 | Barber | 273/199 R |
| 4,222,806 | A | | 9/1980 | Parker | 156/213 |
| 4,300,767 | A | * | 11/1981 | Reed et al. | 473/594 |
| 4,566,696 | A | | 1/1986 | Horgen | 273/193 A |
| 4,577,867 | A | | 3/1986 | Lenhart | 273/176 AB |
| 4,596,389 | A | | 6/1986 | Frankowski | 273/29 A |
| 4,596,392 | A | | 6/1986 | Walker | 273/183 C |
| 4,784,390 | A | | 11/1988 | Horgen | 273/77 A |
| 4,836,552 | A | * | 6/1989 | Puckett et al. | 473/372 |
| 4,839,116 | A | | 6/1989 | Puckett et al. | 264/45.3 |
| 4,886,275 | A | * | 12/1989 | Walker | 473/280 |
| 4,995,613 | A | * | 2/1991 | Walker | 473/280 |
| 5,026,054 | A | * | 6/1991 | Osher et al. | 473/594 |
| 5,601,503 | A | | 2/1997 | Yamagishi et al. | 473/384 |
| 5,630,763 | A | | 5/1997 | Li-Tsan | 473/200 |
| 5,651,680 | A | | 7/1997 | Levy | 434/252 |
| 5,782,702 | A | | 7/1998 | Yamagishi et al. | 473/280 |
| 6,012,997 | A | * | 1/2000 | Mason | 473/594 |
| 6,045,454 | A | * | 4/2000 | Chu | 473/280 |
| 6,217,458 | B1 | | 4/2001 | Armstrong, III et al. | 473/193 |
| 6,544,130 | B1 | | 4/2003 | Weidenhammer | 473/351 |
| 6,986,719 | B2 | | 1/2006 | Kennedy, III | 473/378 |
| 7,549,930 | B2 | | 6/2009 | Rice | 473/165 |
| 7,559,862 | B2 | * | 7/2009 | Von Heland | 473/594 |
| 7,780,544 | B2 | | 8/2010 | Anton | 473/257 |
| 7,819,762 | B2 | | 10/2010 | Bernal-Silva et al. | 473/409 |
| 2002/0039930 | A1 | | 4/2002 | Smith | 473/215 |
| 2004/0209701 | A1 | * | 10/2004 | Finkel | 473/280 |
| 2009/0312127 | A1 | * | 12/2009 | Kessler | 473/570 |
| 2013/0316841 | A1 | * | 11/2013 | Coleman | 473/280 |

* cited by examiner 30
40
15
15

GOLF TRAINING BALL

CROSS-REFERENCE TO PROVISIONAL APPLICATION(S)

This application claims the benefit of U.S. Provisional Application No. 61/463,485, filed Feb. 17, 2011, the disclosure of which is incorporated herein in full by this reference thereto.

BACKGROUND AND SUMMARY OF THE INVENTION

The invention relates to golf training balls and, more particularly, to a construction with a non-deformable inner ball rolling freely in the spherical hollow core of a rubber outer carcass provided with a drag-inducing cover.

It is an object of the invention to provide a golf training ball that simulates fairly closely the experience of hitting a regulation (eg., USGA-approved) golf ball with drivers and/or irons, but otherwise has a very short flight. Hence the training ball is easy to retrieve or enables practice in yards or lawns much smaller than a typical driving range.

In other words, it is an object of the invention that the user can walk out his or her home's front or back door, and practice with any club up to and including a driver.

It is another object of the invention that such a golf training ball compress on the face of the club driver much like the experience with hitting a regulation golf ball for—among other reasons—enabling the user to feel or discern where on the club face contact was made with the training ball.

It is an additional object of the invention that such a golf training ball, albeit adapted to provide a short flight, at least initially launch off the club face pretty similar to the way a regulation ball would (with a similar swing and struck in a similar location on the club face), in order to give the user more accurate feedback as to launch angle and curve trajectory had the swing been made on a regulation ball instead of the training ball.

It is a further object of the invention that such a ball have a satisfying noise when struck well by the club, again simulative to the sound of a well-struck regulation ball off the same club so as to provide the user with further positive feedback of training success.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 10 is a reduced scale elevational view comparable to FIGS. 7-9 except showing that the golf training ball in accordance with the invention has a typical flight of about one-fourth of a standard regulation golf ball.

DETAILED DESCRIPTION OF THE PREFERRED EMBODIMENTS

Figure 1:
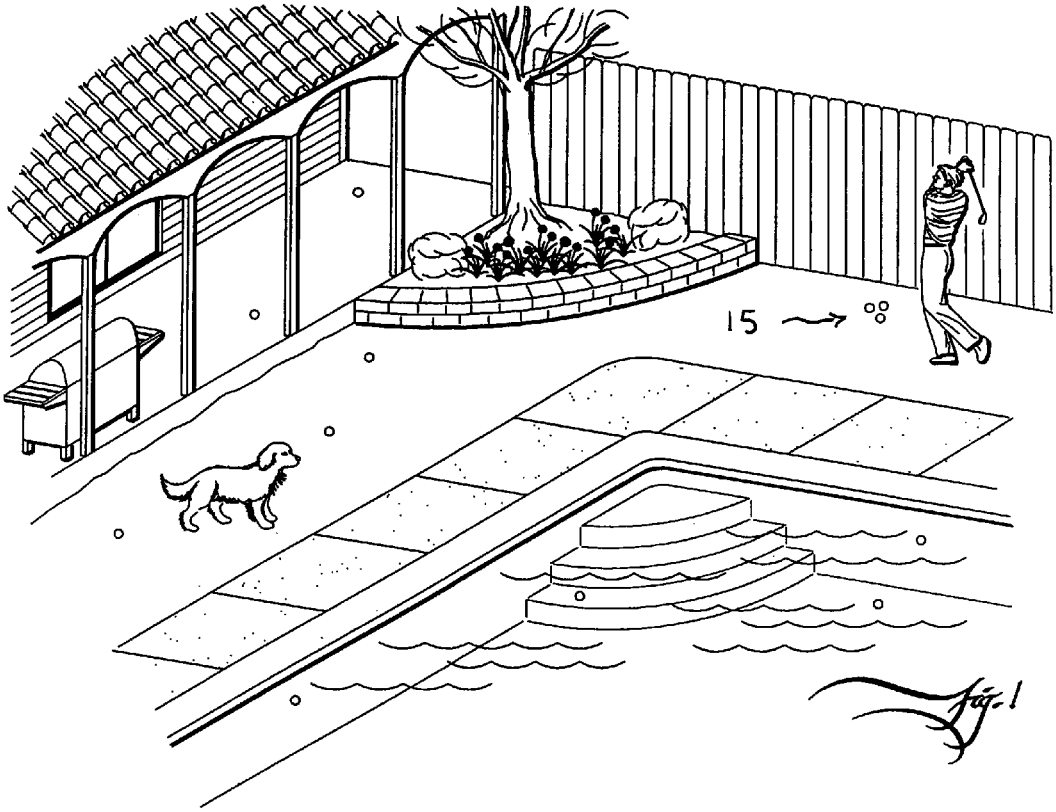
FIG. 1 is a perspective view of a training session with golf training balls in accordance with the invention in a user's own backyard.
Figure 2:
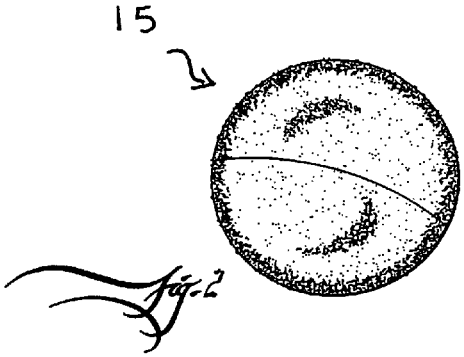
FIG. 2 is an enlarged scale perspective view of a single golf training ball in accordance with the invention.
Figure 3:
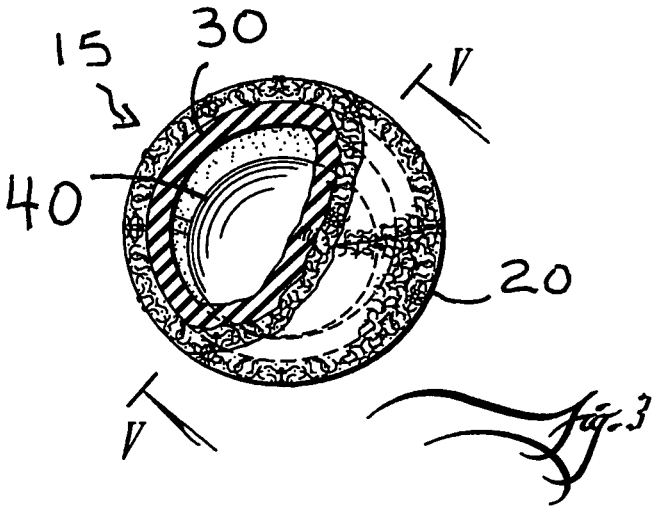
FIG. 3 is a view comparable to FIG. 2 except with portions of the rubber carcass and felt cover removed from view to show the inner ball.
Figure 4:
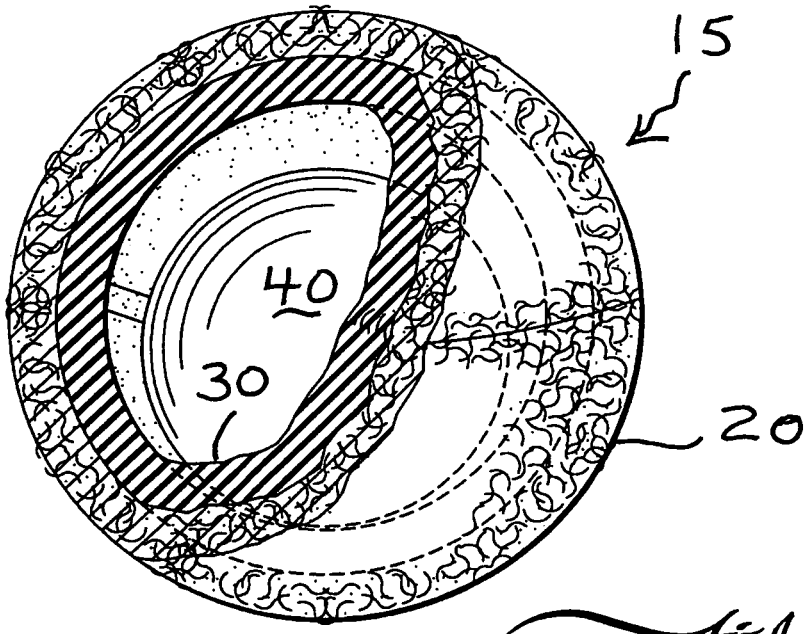
FIG. 4 is a view comparable to FIG. 3 except on an enlarged scale.

As FIG. 1 shows, it is an object of the invention that the user can walk out his or her home's front or back door and practice hitting a golf training ball 15 in accordance with the invention with any club. Although an iron is shown, the options include any club up to and including a driver.

The golf training ball 15 is designed to fly about one-fourth the distance of a standard regulation ball, and is rubbery and covered in a thick fuzzy cover so that it is likely to impact errant objects lightly.

FIGS. 2-6 show better a golf training ball 15 in accordance with the invention. This golf training ball 15 is designed in particular for users training with their irons and drivers. It is not particularly designed for putter training because, putting is so easily practiced about anywhere with regulation golf balls. This golf training ball 15 is designed so that the user can feel the training ball 15 come off the club like a regulation golf ball, but not fly as far. Trials to date with prototype training balls 15 in accordance with the invention flew on average about fifty to seventy yards (~50 to 70 m) for an experienced long-hitter swinging with his driver.

The training ball 15 in accordance with the invention differs from the prior art training balls in following ways, namely:—

- in the properties of the cover 20, mainly in respect of aerodynamic properties,
- in the construction, mainly in respect of a layered construction,
- in the degree of hardness/softness among the layers,
- in the relative resiliency of the layers,
- in the weight distribution among the layers, and
- in the density distribution among the layers.

The overall weight and diameter of the golf training ball 15 also influence performance. The preferred ranges for the overall weight and diameter of the golf training ball 15 vary from slightly less than a regulation ball, to about the same weight and diameter as a regulation ball, or maybe even slightly over-sized.

Regarding the properties of the cover 20, the cover 20 preferably comprises an outer layer of natural or synthetic felt (ie., 20), comparable to and as inspired by the felted outer layer of tennis balls.

The U.S. Pat. No. 4,577,867—Lenhart discloses a method of making a fuzz-covered, rubber ball by hot melt adhesion of a fuzz cover to a rubber core. The method includes the steps of providing a fuzz ball cover of a cut, dimension and configuration to cover the rubber core. The material of the fuzz cover comprises a fabric including yarns fabricated from a hot-melt adhesive composition. The cover is assembled onto the rubber core and then everything together is heated up to temperature. The adhesive yarns melt at the interface with the rubber core to form a bond between the core and cover. The melted portions are afterwards allowed to cool and to solidfy. And thus a fuzz cover is adhered to a rubber core. The U.S. Pat. No. 4,577,867—Lenhart is incorporated herein by this reference thereto.

The training ball 15 preferably comprises a hard spherical core 40, and preferably solid:—but if hollow, then at least hard thick-walled hollow sphere. The diameter of the core 40 might vary anywhere from a low extreme of about ⅓rd (one-third) the diameter of the golf training ball 15 as a whole, to a high extreme of the inside diameter of the hollow interior of the spherical rubber carcass 30. Presumptively, the outside diameter of the core 40 is preferred to be smaller than the hollow inside diameter of the spherical rubber carcass 30.

Figure 5:
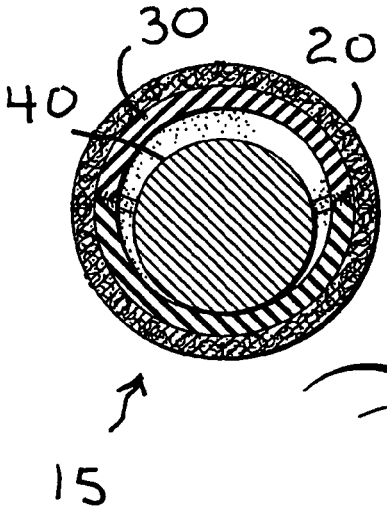
FIG. 5 is a sectional view taken along line V-V of FIG. 3.
Figure 6:
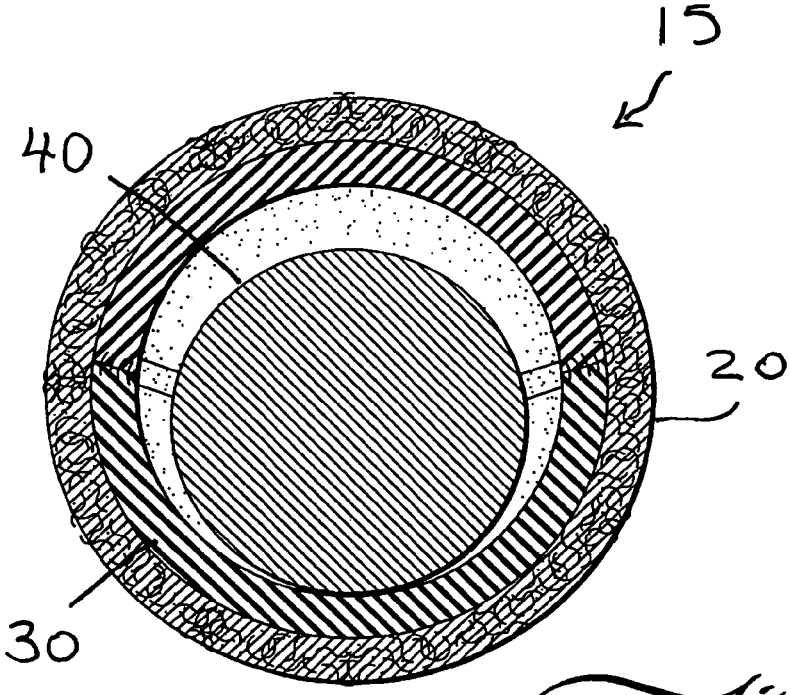
FIG. 6 is a view comparable to FIG. 5 except on an enlarged scale.

It is an aspect of the invention that the hard spherical core 40 is not solidly attached to the rubber carcass 30. Hence, there is air between the core 40 and carcass 30. In this respect, the hard spherical core 40 as shown in FIGS. 5 and 6 is as free to roll around inside the rubber carcass 30 as a bead in a rattle. In fact, if the user shakes the golf training ball 15 in accordance with the invention, it does rattle faintly.

Figure 11:
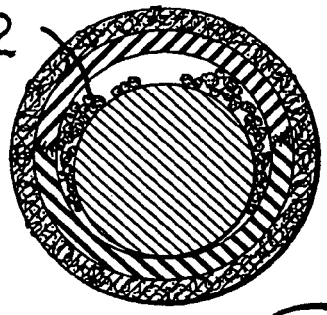
FIG. 11 is a view comparable to FIG. 5 except of an alternate embodiment.

If the rattling is not desired, a little bit of loose foam shreds 42 can be inserted inside the hollow cavity of the rubber carcass, and as shown in FIG. 11.

Figures 7, 8:
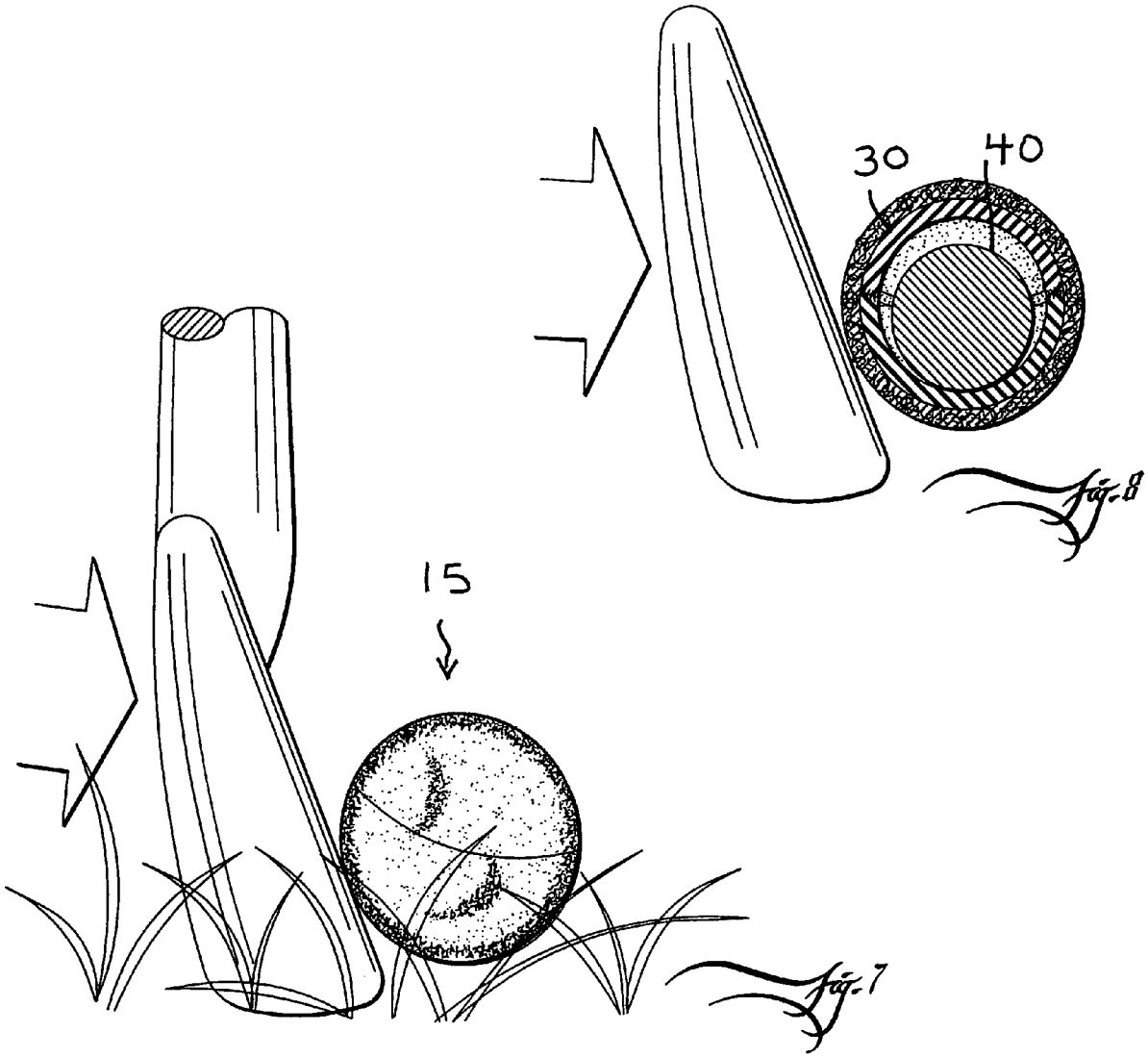
FIG. 7 is a side elevational view showing an example of training with the golf training ball in accordance with the invention or, more particularly, representing the moment the golf training ball is about to be struck by the club face of an iron.
FIG. 8 is a view comparable to FIG. 7 except showing the golf training ball in section.
Figures 9, 11:
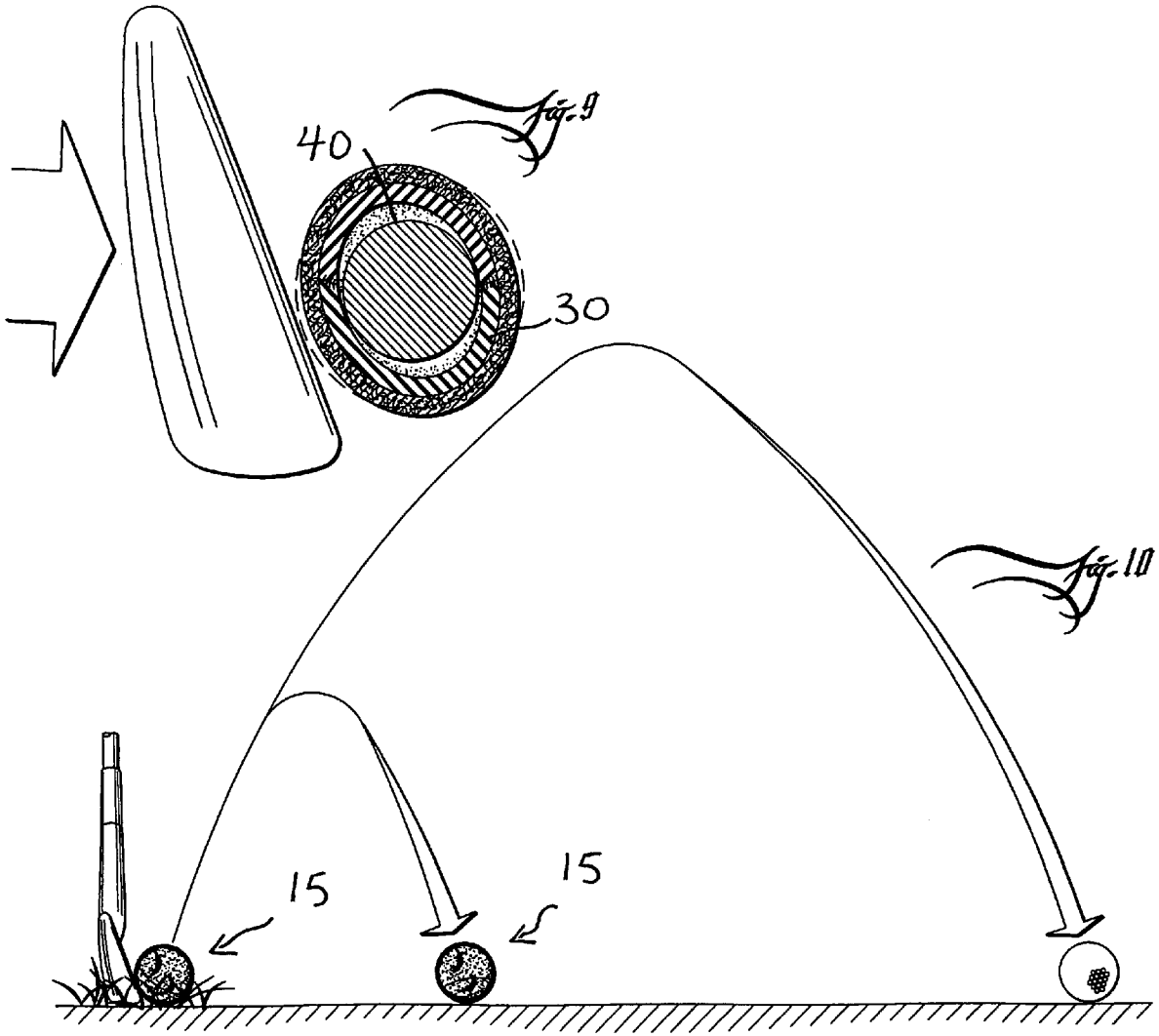
FIG. 9 is a view comparable to FIG. 8, except representing a later time, at about the moment the golf training ball just barely separates from the club face.

Nevertheless, it is an aspect of the invention that such loose foam shreds 42 do not interfere with the movement of the hard inner core 40 as shown in FIGS. 8 and 9.

If the hard inner core were solidly attached to the rubber carcass 30, and if it ever got unbalanced, then the golf training ball 15 would never fly straight/

Hence the preferred layer construction of the training ball 15 comprises four layers:

(1) a hard preferably solid inner core 40, (2) a some rattle-dampening shreds 42 with about zero position-retention properties on the position of the hard inner core 40, (3) a fairly substantially-thick wall comprising a rubber or latex carcass 30, (ie., fairly thick relative the small diameter of the carcass 30), and (4) (excluding an adhesive film, if any) a fairly substantially-thick felt cover 20.

In view of the foregoing, the training ball 15 in accordance with the invention has a fairly thick-walled rubber carcass 30. The felt cover 20 is also fairly thick, and preferably fluffed out, to be fuzzy, and provide a substantial amount of drag. It is an aspect of the invention that the drag (wind resistance) of the felt cover 20 causes a number of the advantageous effects of the golf training ball 15.

When the golf training ball 15 is struck, and launches off the club face, the felt 20 catches the air sooner than would the dimpled surface of a regulation ball.

For one thing, the effects of the spin on the ball 15 are shown sooner than on the trajectory of a regulation ball. These effects include not only the curve of the trajectory to the left or right, but also the effect on the flight of the ball 15 relative to the launch angle. That is, the ball 15 might climb up or dive down from an otherwise desirable launch angle.

For another thing, the felt 20 causes the training ball 15 to slow down faster than a regulation ball too, and not fly as far. Hence a user can swing as hard as he or she wants with his or her biggest club, and watch the training ball 15 take an abbreviated flight.

If a regulation ball would have curved given the same swing and contact, then the training ball 15 is designed to do so too:—and in the same direction. The training ball 15 just does so sooner, but about nearly as wide in proportion to flight distance. Likewise, if a regulation ball would have climbed away from or dove off the launch angle, then the training ball 15 is designed to do this as well also. It is believed that the thicker and/or more fluffed the felt 20, the more drag.

It is believed that the drag is created by air flowing through the fuzz of the felt 20, and the fuzzier of more fluffed, the more drag. Spin on the training ball 15 converts the drag into the "bite" that gives the training ball 15 a curving trajectory and/or other control over the training ball 15. Drag is confidently believed to be the main factor which reduces the flight distance.

Further advantages of the felted rubber carcass 30 for the golf training ball 15 in accordance with the invention include the following. The felted rubber carcass 30 is relatively tough, hence making the golf training ball 15 relatively durable. The felted rubber carcass 30 also provides fair to decent shock absorption should the training ball 15 hit an errant target, making the landings for the training ball 15 surely safer to objects in and around the house and yard than for a regulation ball.

Once again, it is an aspect of the invention that the golf training ball 15 perform for the user in order to clearly show side spin (eg., curve trajectory) and launch angle. Needless to say, these are two very important pieces of information for a golfer. It is furthermore important that the user can feel where the training ball 15 came off the club face. It is desirable and satisfying if the training ball 15 sounds like a regulation ball.

Sound production is obtained from the hard inner core 40. It is preferred if the inner core 40 is solid. A list of preferred candidate materials and/or objects include without limitation:—

- a plastic or other synthetic-material sphere or thick-walled ball, wherein,
  - choices of such plastic and/or synthetic material include without limitation:
    - polypropylene,
    - nylon balls (ie., which are hard and durable),
    - acrylic balls or spheres,
    - DELRIN®,
    - santoprene rubber (or elastomer),
    - TEFLON®, and so on.
- wood,
- a miniature golf ball constructed like a regulation ball except on miniature scale, and,
- a glass marble (with the only concern is that it might dent a driver face or the like).

For wood core 40s, the species of wood matters too. It is presumed that particularly hard and dense woods might harm a driver face. In fact, the same pre-caution applies to any material for the core 40. It is noted that, hardness and density are different properties. For example, oak is a relatively dense wood but only semi-hard on the wood hardness scale (ie., Janka scale). In contrast, mesquite has a hardness on the Janka scale that is much harder than oak, but is not as dense (although Mesquite is fairly dense too). And so on, with many surprises, including that hard maple is neither very hard nor very dense.

Nevertheless, the inventor hereof has tested trial prototypes with a glass marble core and has had positive experiences, with no detriment to his driver. However, the thickness of the rubber carcass 30 in the prototypes used with the marble was the thickest of the thick-walled prototypes he had available.

The size and material of the core 40 affects flight distance and sound off the club face. For a training ball 15 with a regulation diameter, the preferred range of size for the core 40 is between ⅝ and 1⅛ inches (–16 and –28 mm) outside diameter.

Again, the core 40 will rattle without any rattle-dampening shreds 42. But once again, the inventor hereof has tested trial prototypes not only with a glass marble for a core 40 but glass marbles which rattled in their carcasses 30—and he still had positive experiences.

Hence the core 40 does a number of useful things. The core 40 gives the user the satisfying (and useful) sound that simulates what an actual regulation ball sounds like.

The core 40 also gives the user the feel of hitting something solid like an actual regulation ball. Because of the core 40, the user can feel the training ball 15 come off the club face, which is valuable for feedback (eg., off the toe, off the heel, too low on the face, etc.).

The size and weight of the training ball 15 can be the same as a regulation ball, or it can be a little bigger or smaller. If it weighs less than a regulation ball, the training ball 15 is believed to not travel as far as the training ball 15 would if it weighed the same as or heavier than a regulation ball (but not fly nearly as far as a regulation ball in any event).

FIGS. 7 through 10 comprise a series of views to illustrate the design preference for leaving the core 40 loose inside the carcass 30. FIG. 7 shows the club face of iron swinging through the golf training ball 15 in accordance with the invention. More accurately, FIG. 7 represents the moment or instant before the golf training ball 15 is about to be struck by the club face of an iron.

FIG. 8 is a view very comparable to FIG. 7. The difference is that, the golf training ball 15 in accordance with the invention is shown in section. The inner core 40 just rests at rest in the bottom of the carcass 30, centered right in the center of the bottom.

FIG. 9 is a view comparable to FIG. 8, except representing a moment later in time. In FIG. 9, the club face has slammed in the ball 15, setting the ball into a launch off the face. FIG. 9 shows the moment when the golf training ball 15 has just barely separated from the club face.

FIG. 9 shows what is believed to take place. The inner core 40 is believed to climb up the wall of the carcass 30 until the core 40 now occupies a position centered on a normal axis from the club face, which normal axis (although not shown) would extend through a center of geometry of the golf training ball 15. The carcass is believed to pancake into a fairly symmetric ellipsoid. To speculate even more particularly still, it is believed that the rubber carcass will pancake into an oblate spheroid, which is a rotationally symmetric ellipsoid having a polar axis shorter than the diameter of the equatorial circle whose plane bisects it.

Oblate spheroids stand in contrast to prolate spheroids. For prolate spheroids, the polar axis is greater than the diameter of the equatorial circle whose plane bisects the prolate spheroid.

In any event, it is believed that the normal axis extending out of the club face is coincident with the polar axis (of symmetry) of the oblate spheroid shape that is shown by FIG. 9. It is also believed that the inner core 40 is symmetrically on axis with the same polar axis of the rubber carcass 30.

What happens in time after FIG. 9 can only be guessed at. It may be that the rubber carcass 30 oscillates briefly between cycles of being an oblate spheroid, to a prolate spheroid, back to oblate and so on until the oscillations die out. It is also believed that the oscillations do die out quickly. Wherever the inner core 40 goes is not known. But the inventor finds, in his test hits, that if he hit the golf training ball 15 with a swing that in his experience would have produced true straight flight for a regulation ball, the training ball 15 does so too. Thus the inner core 40 does not seem to detract in the least from the flight of the golf training ball 15.

However, when trials were made with attempts to solidify the core 40 into a fixed position, two bad results happened. First, if the core 40 were not centered perfectly, the golf training ball 15 would wobble in flight from the first test hit.

Second, even if the core 40 were initially centered pretty good, a few hits of the golf training ball 15 would dislodge the core 40, and it would shift off center and not be able to return because of the enmeshing media had also deformed.

Thus it was discovered that it was a more successful plan, for the longevity of the golf training ball, if the core were left loose inside the carcass 30.

FIG. 10 shows the hoped for result. It shows a practice hit with the ball 15 which flies a fraction the distance if compared to a regulation ball, except with all the advantages of otherwise fairly similarly simulating the same experience. As shown by FIG. 10, the golf training ball 15 in accordance with the invention has a typical flight of about one-fourth of a standard regulation golf ball.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A short-flight golf training ball comprising:

a spherical hollow rubber carcass having a spherical outer wall and a spherical interior wall defining a hollow spherical interior having an interior diameter;

a felt cover affixed to the outer wall; and a hard spherical inner core having an outer diameter that is less than interior diameter of the carcass and is free to substantially free to move around in the hollow spherical interior.

2. The golf training ball of claim 1, wherein:

the hollow rubber carcass has a wall thickness, and, the felt cover has a thickness which is about the same as the wall thickness of the hollow rubber carcass.

3. The golf training ball of claim 2, wherein:

the felt cover is fluffed out to be fuzzy.

4. The golf training ball of claim 1, wherein:

the inner core is solid.

5. The golf training ball of claim 1, wherein:

the hard inner core comprises a miniature golf ball constructed like a regulation ball except on miniature scale.

6. The golf training ball of claim 1, wherein:

the hard inner core comprises a plastic sphere or thick-walled ball.

7. The golf training ball of claim 6, wherein:

the hard inner core comprises any of polypropylene, nylon, acrylic, DELRIN®, santoprene rubber, or TEFLON®.

8. The golf training ball of claim 6, wherein:

the hard inner core comprises hard rubber.

9. The golf training ball of claim 1, wherein:

the hard inner core comprises a wooden sphere.

10. The golf training ball of claim 1, wherein:

the hard inner core comprises a glass marble.

11. The golf training ball of claim 1, further comprising:

loose shreds of rattle dampening material in the hollow interior along with the hard inner core, wherein said loose shreds impose virtually none to minuscule position-retention constraints on the position of the hard inner core.

12. The golf training ball of claim 1, further comprising:

foam rattle dampening material in the hollow interior along with the hard inner core, wherein said foam imposes virtually none to minuscule position-retention constraints on the position of the hard inner core.

13. The golf training ball of claim 1, further comprising:

rattle dampening material in the hollow interior along with the hard inner core, wherein said rattle dampening material imposes virtually none to minuscule position-retention constraints on the position of the hard inner core.

14. The golf training ball of claim 1, further comprising:

rattle dampening material occupying the hollow interior along with the hard inner core but neither adhered nor attached to either the hard inner core or carcass, wherein said rattle dampening material imposes virtually none to minuscule position-retention constraints on the position of the hard inner core.

15. A short-flight golf training ball comprising:

a spherical hollow rubber carcass having a spherical outer wall and a spherical interior wall defining a hollow spherical interior having an interior diameter;

a cover affixed to the outer wall; and a hard spherical inner core having an outer diameter that is less than interior diameter of the carcass and is free to substantially free to move around in the hollow spherical interior;

wherein the cover comprises a fuzzy material.

16. The golf training ball of claim 15, wherein:

the cover comprises a drag-inducing material.

17. The golf training ball of claim 15, wherein:

the hard inner core comprises a plastic sphere or thick-walled ball.

18. The golf training ball of claim 15, wherein:

the hard inner core comprises any of polypropylene, nylon, acrylic, DELRIN®, santoprene rubber, or TEFLON®.

19. The golf training ball of claim 15, wherein:

the hard inner core comprises a wooden sphere.

* * * * *